United States Patent [19]

Koskinen et al.

[11] Patent Number: 4,779,670

[45] Date of Patent: Oct. 25, 1988

[54] METHOD AND APPARATUS FOR CHANGING THE MOULD IN A CASTING MACHINE

[75] Inventors: Taisto I. Koskinen, Pori; Markku M. A. Rajaviita, Ulvila; Erkki O. Levo, Espoo; Jouko T. Luoto, Helsinki, all of Finland

[73] Assignee: Outokumpu Oy, Helsinki, Finland

[21] Appl. No.: 83,254

[22] Filed: Aug. 6, 1987

[30] Foreign Application Priority Data

Aug. 29, 1986 [FI] Finland ..... 863513

[51] Int. Cl.[4] ..... B22D 11/08

[52] U.S. Cl. ..... 164/459; 164/418; 164/483; 164/426

[58] Field of Search ..... 164/412, 418, 483, 459, 164/425, 426, 445, 446

[56] References Cited

U.S. PATENT DOCUMENTS

| | | | |
|---|---|---|---|
| 3,167,829 | 2/1965 | Hess et al. | 164/442 |
| 3,273,208 | 9/1966 | Greenberger | 164/420 |

FOREIGN PATENT DOCUMENTS

| | | | |
|---|---|---|---|
| 3407391 | 9/1984 | Fed. Rep. of Germany | 164/446 |
| 2442093 | 7/1980 | France | 164/418 |
| 959907 | 9/1982 | U.S.S.R. | 164/418 |

*Primary Examiner*—Nicholas P. Godici
*Assistant Examiner*—Richard K. Seidel
*Attorney, Agent, or Firm*—Dellett, Smith-Hill and Bedell

[57] ABSTRACT

The invention relates to a method and apparatus for changing the casting table, complete with the mold and the starter head in the casting machine, particularly a semi-continuous casting machine. In order to carry out the exchange, the casting table (7) complete with the mold (10) and the starter head (5) are first supported against each other, whereafter the casting table (7) and the starter head (5) are together shifted in between the casting position and the changing position.

13 Claims, 3 Drawing Sheets

METHOD AND APPARATUS FOR CHANGING THE MOULD IN A CASTING MACHINE

The present invention relates to a method and apparatus for changing the casting table, complete with the mould and the starter bar in a casting machine, particularly in a semi-continuous casting machine.

The conventional method for attaching the starter bar in semi-continuous casting machines is to attach it with bolts to the casting elevator. Both the detaching and attaching are carried out manually, which means that the working position is awkward and the working spot is located on top of the water tank. The hoisting of both the mould and the starter head is performed by means of a crane. Thus the changing of the mould and the starter head forms a separate operation altogether, which disturbs the cyclic rhythm of the casting process.

The purpose of the present invention is to eliminate some of the drawbacks of the prior art and to achieve an improved method, both quicker and more secure in operation, for changing the casting table, complete with the mould and the starter head, so that while employing this method, the cyclic rhythm of the casting process is advantageously maintained unchanged. Another object of the invention is an apparatus for realizing the method of the invention. The essential novel features of the invention are apparent from the appended patent claims.

According to the invention, the casting table, complete with the mould and the starter head, are supported against each other so that by aid of shifting members, the mould and the starter head together can advantageously be transported to the vicinity of the casting machine so that the changing or maintenance proper can be carried out in this position. In order to advantageously realize the method of the invention, the shifting members of the casting table and the starter head are operated so that during a casting cycle, at least one additional casting member combination comprising a casting table and a starter head can be prepared for successive operation. Thus the changing of the casting table and the starter head is performed in an essentially quick fashion by replacing the preceding casting member combination in the casting position by the newly prepared combination of casting table and starter head. According to the invention, when the changing of the casting table and the starter head is carried out in an advantageous fashion, there is no essential change in the cyclic rhythm of the castings.

In the following the invention is explained in more detail with reference to the appended drawings, where FIG. 1 is an illustration of a preferred embodiment of the invention, seen in a partial side-view elevation;

Figure 1:
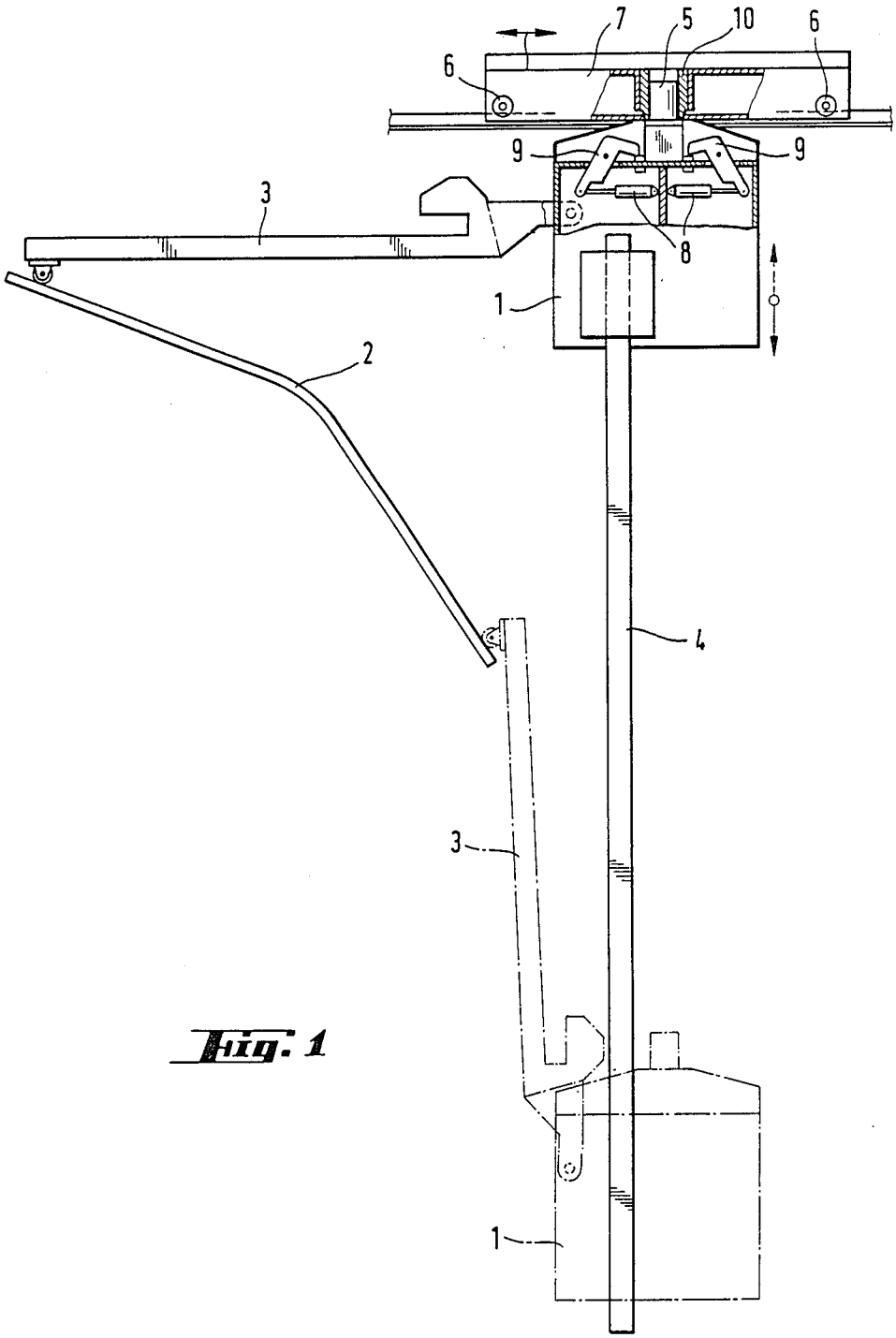

According to FIG. 1, the casting elevator 1 is, by aid of the product wagon 3, moving along the path 2, hoisted from the position marked by dotted lines, along the rail 4 to a position where the advantageous changing, according to the method of the invention, of the casting table 7 complete with the mould and the starter head 5 is carried out. Moreover, in the vicinity of this position, there are installed shifting members 6 in order to advantageously shift the casting table 7 and the starter head 5 to the changing position and in order to transport and fit another, essentially similar casting member combination, to the operational position ready for casting. The shifting members 6 are advantageously operated for instance hydraulically, pneumatically or electrically.

Figure 2:
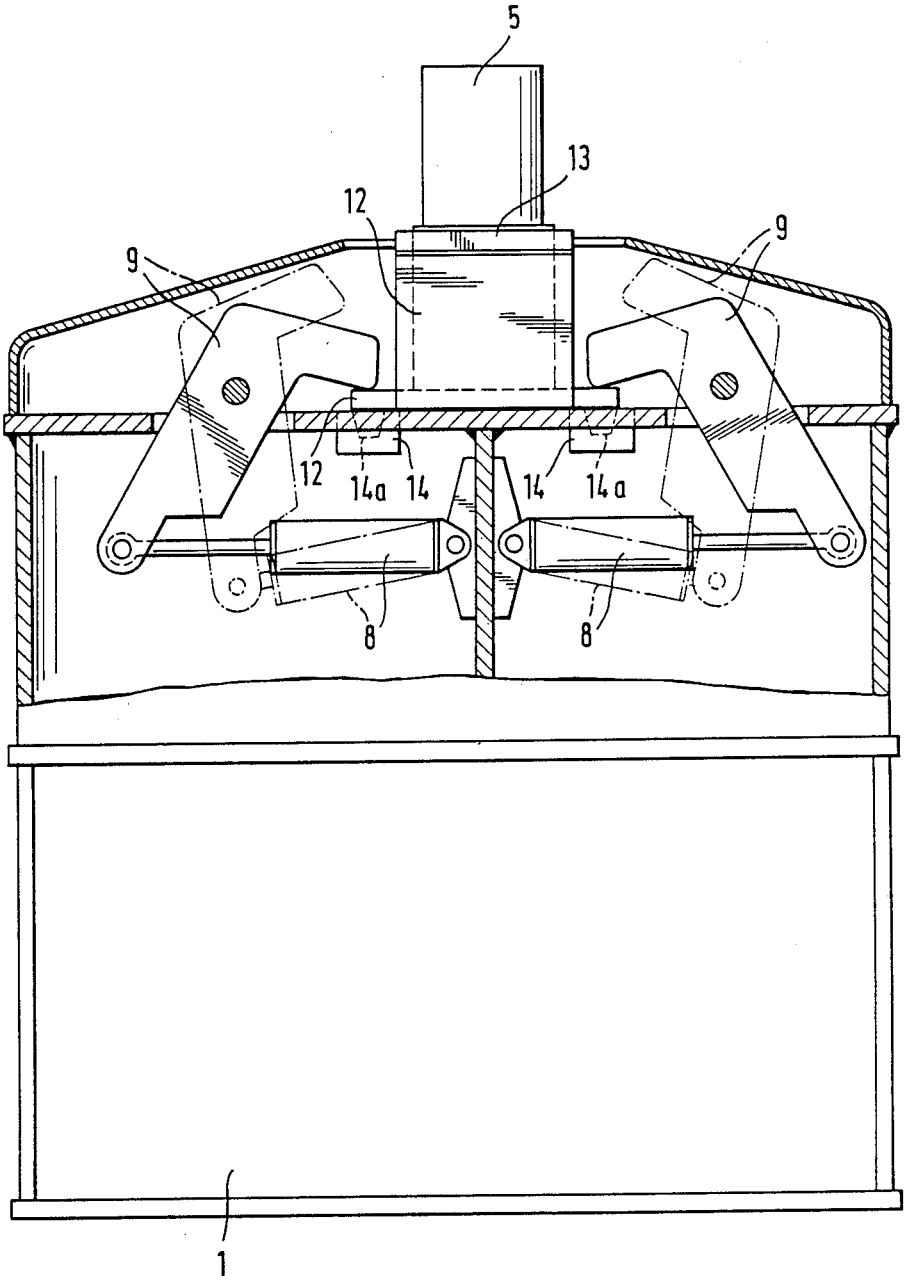
FIG. 2 is an illustration of the casting elevator of the preferred embodiment of FIG. 1, seen in a partial side-view elevation.
Figure 3:
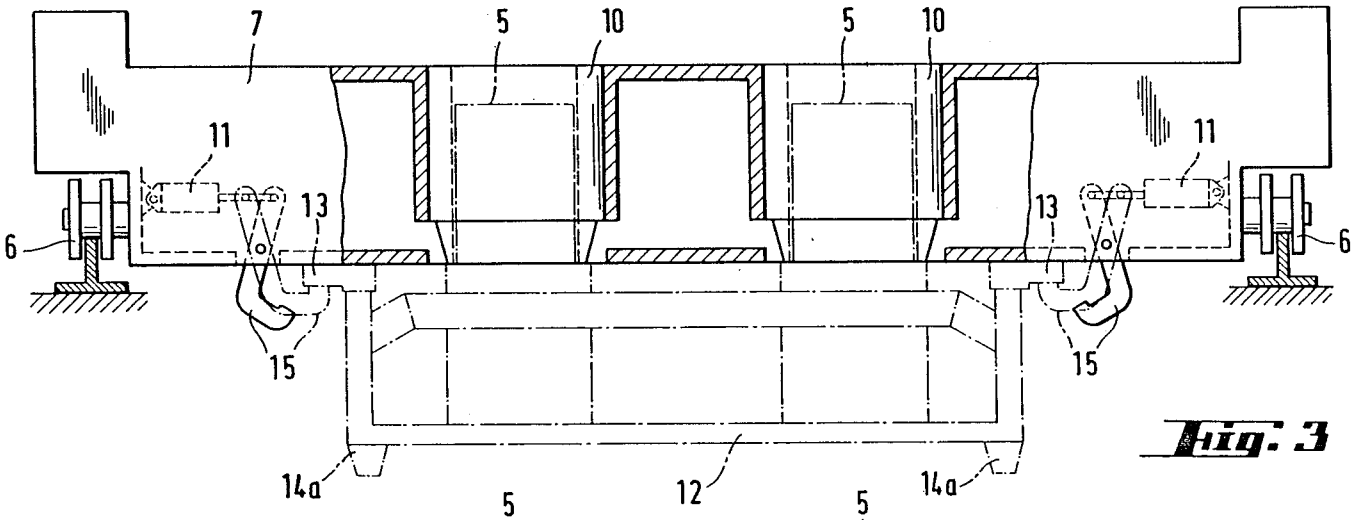
FIG. 3 is an illustration of the casting table of the preferred embodiment of FIG. 1, seen in a partial side-view elevation.
Figure 4:
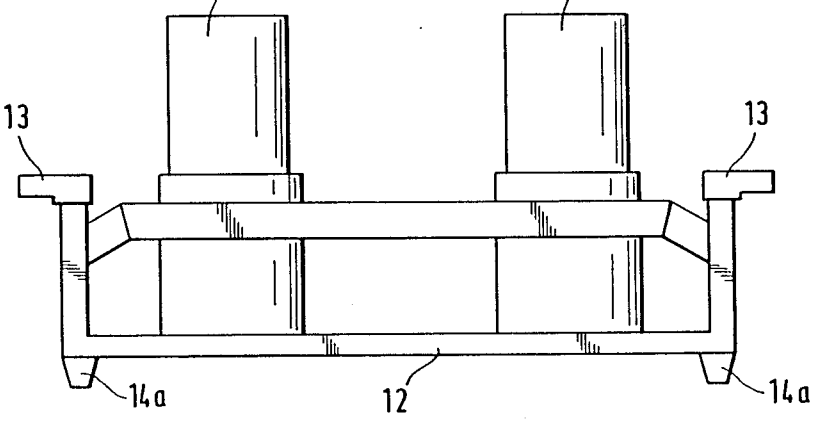
FIG. 4 is an illustration of the starter head of the preferred embodiment of FIG. 1, seen from the side.

FIGS. 2–4 illustrate in more detail the members presented in FIG. 1. FIG. 2 shows how the locking members 9 installed in the casting elevator 1 and connected to the cylinders 8 lock the starter head 5 into place in the casting elevator 1 for the duration of the casting operation. In order to change the used combination of the casting table 7, including the mould 10 (FIG. 3), and the starter head 5, the locking effect of the locking members 9 is first released by aid of the cylinders 8. Thereafter the other cylinders 11 connected to the casting table 7 are moved, with respect to the supporting structures 12 of the used starter head (FIG. 4), in such a fashion that the supporting members 15 connected to the cylinders 11 support the starting head 5 by aid of the bearing members 13. When the casting table 7 and the used starter head 5 are thus mutually supported, the casting elevator 1 is moved downwards along the rail 4 so that the guiding trunnions 14 connected to the casting elevator 1 are disengaged from the pins **14*a* in the used starter head 5. By means of the shifting members 6, the used combination of the casting table 7 and the starter head 5 constructed according to the method of the invention is advantageously shifted away and essentially simultaneously replaced with a new, essentially similar combination of casting table 7 and starter head 5. After the new combination of casting table 7 and starter head 5 has reached the casting position, the casting elevator 1 is driven upwards along the rail 4 in order to centralize the new starter head 5 in relation to the casting elevator 1 by aid of the guiding trunnions 14. The new starter head 5 is released from the casting table 7 by disengaging the supporting members 15 from the bearing members 13. Finally the new starter head 5 is locked, by means of the locking members 9, to the casting elevator 1**, whereafter the casting process can advantageously be started.

While employing—in order to achieve the locking and support of the starter head according to the invention—such cylinders or electric actuators that are operated advantageously hydraulically, pneumatically or electrically, the changing of the mould and the starter head can be advantageously speeded up so that the cyclic rhythm of the casting process is not essentially disturbed. Moreover, the disturbance for the cyclic rhythm of the casting process can advantageously be reduced so that each new combination of casting table and starter head is heated up, essentially to a temperature near the one achieved during the casting process, which temperature can also, owing to the essentially quick exchange, be maintained in the combination.

We claim:

1. A method of changing the mold and starter member of a casting machine, comprising:

attaching the starter member to the mold while in a casting position, moving the starter member and the mold attached thereto from the casting position to a second position, moving a second starter member and a second mold attached thereto to the casting position, and detaching the second starter member from the second mold.

2. A method according to claim 1, wherein the casting machine includes transport means movable along a path towards and away from the casting position, and the method further comprises attaching the second starter member to the transport means.

3. A casting machine comprising:

a casting table, means defining a casting position for the casting table, a mold carried by the casting table, a starter member, transport means movable along a path towards and away from the casting position, means for releasably attaching the starter member to the transport means, whereby the starter member can be moved relative to the mold, means for releasably attaching the starter member to the casting table, and means for moving the casting table having the starter member attached thereto from the casting position to a second position which is spaced from the casting position.

4. A casting machine according to claim 11, wherein the means for releasably attaching the starter member to the transport means comprise at least one latch member carried by the transport means and movable between a first position in which it engages the starter member and a second position in which it does not engage the starter member, and actuator means for selectively placing the latch member in its first position or its second position.

5. A machine according to claim 4, wherein the actuator means comprise a hydraulic cylinder.

6. A machine according to claim 4, wherein the actuator means comprise a pneumatic cylinder.

7. A machine according to claim 4, wherein the actuator means comprise an electrically-operated actuator.

8. A machine according to claim 3, wherein the means for releasably attaching the starter member to the casting table comprise at least one latch member carried by the casting table and movable between a first position in which it engages the starter member and a second position in which it does not engage the starter member, and actuator means for selectively placing the latch member in its first position or its second position.

9. A machine according to claim 8, wherein the actuator means comprise a hydraulic cylinder.

10. A machine according to claim 8, wherein the actuator means comprise a pneumatic cylinder.

11. A machine according to claim 8, wherein the actuator means comprise an electrically-operated actuator.

12. A method of changing the mold and starter member of a semi-continuous casting machine, comprising:

attaching the starter member to the mold while in a casting position, moving the starter member and the mold attached thereto from the casting position to a second position, moving a second starter member and a second mold attached thereto to the casting position, and detaching the second starter member from the second mold.

13. A semi-continuous casting machine comprising:

a casting table, means defining a casting position for the casting table, a mold carried by the casting table, a starter member, transport means movable along a path towards and away from the casting position, means for releasably attaching the starter member to the transport means, whereby the starter member can be moved relative to the mold, means for releasably attaching the starter member to the casting table, and means for moving the casting table having the starter member attached thereto from the casting position to a second position which is spaced from the casting position.

* * * * *